US010072905B2

(12) United States Patent
Skupin

(10) Patent No.: US 10,072,905 B2
(45) Date of Patent: Sep. 11, 2018

(54) PAINTBALL BACKPACK FOR STORING, TRANSPORTING, AND/OR CONVEYING PROJECTILES, AND METHOD FOR CONVEYING PROJECTILES

(71) Applicant: Maxxloader Limited, Dublin (IE)

(72) Inventor: Michael Skupin, Norderstedt (DE)

(73) Assignee: Maxxloader Limited, Dublin (IE)

( * ) Notice: Subject to any disclaimer, the term of this patent is extended or adjusted under 35 U.S.C. 154(b) by 0 days.

(21) Appl. No.: 15/559,163

(22) PCT Filed: Mar. 18, 2016

(86) PCT No.: PCT/EP2016/055991
§ 371 (c)(1),
(2) Date: Sep. 18, 2017

(87) PCT Pub. No.: WO2016/146822
PCT Pub. Date: Sep. 22, 2016

(65) Prior Publication Data

US 2018/0066914 A1 Mar. 8, 2018

(30) Foreign Application Priority Data

Mar. 18, 2015 (DE) ..... 10 2015 104 004

(51) Int. Cl.
*F41B 11/50* (2013.01)
*F41B 11/53* (2013.01)
(Continued)

(52) U.S. Cl.
CPC ..... *F41B 11/53* (2013.01); *A45F 3/04* (2013.01); *F42B 39/02* (2013.01); *A45F 2003/045* (2013.01)

(58) Field of Classification Search
CPC ..... F41B 11/50; F41B 11/52; F41B 11/53; F41B 11/57
See application file for complete search history.

(56) References Cited

U.S. PATENT DOCUMENTS 5,839,422 A * 11/1998 Ferris ..... F41B 11/52 124/53.5
6,981,493 B1 * 1/2006 Poteracke ..... F41B 11/50 124/45

(Continued)

FOREIGN PATENT DOCUMENTS

DE 199 22 589 A1 12/2000
GB 2 363 188 A 12/2001
WO WO 2007/017830 A2 2/2007

OTHER PUBLICATIONS

International Search Report and Written Opinion for International Application No. PCT/EP2016/055991, dated Jun. 6, 2016.

(Continued)

*Primary Examiner* — John Ricci
(74) *Attorney, Agent, or Firm* — Wolf, Greenfield & Sacks, P.C.

(57) ABSTRACT

The invention relates to a paintball backpack for storing, transporting and/or delivering projectiles to a device for firing the projectiles, comprising a storage container for the projectiles and at least one delivery connection for transporting the projectiles, wherein the paintball backpack comprises a first and at least one second delivery device, wherein the first and the at least one second delivery device are arranged superposed over each other in or on a storage container and are connected to each other by the at least one delivery connection. Furthermore, the invention relates to a method for delivering projectiles from a storage container by at least two delivery devices for transferring the projectiles to a device for firing the projectiles.

15 Claims, 6 Drawing Sheets

Figure 1:
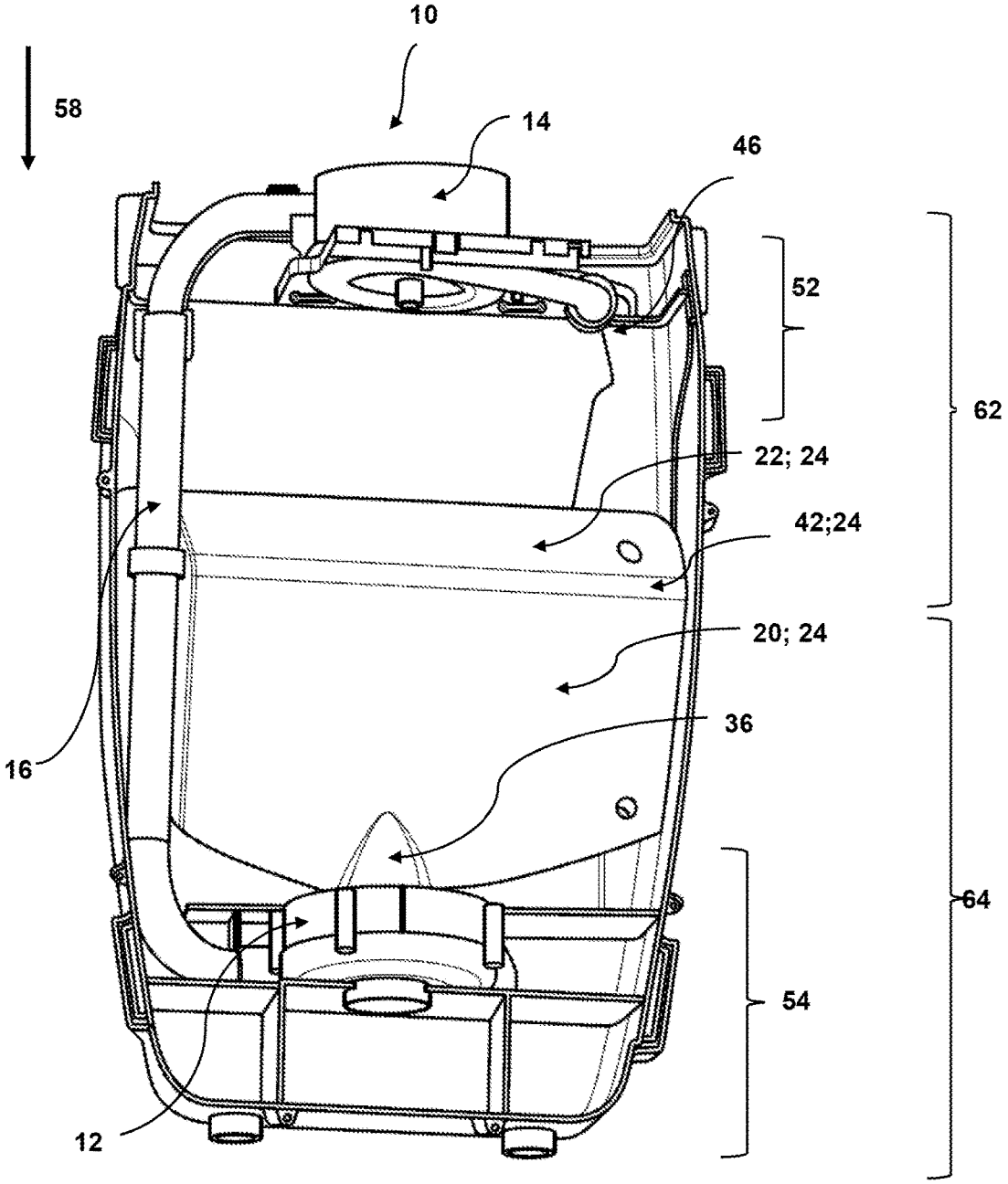

(51) Int. Cl.
*F42B 39/02* (2006.01)
*A45F 3/04* (2006.01)

(56) References Cited

U.S. PATENT DOCUMENTS

| | | | | |
|---|---|---|---|---|
| 7,270,121 | B2 * | 9/2007 | Lubben | F41B 11/53 124/51.1 |
| 7,770,569 | B2 * | 8/2010 | Andresen | F41B 11/53 124/51.1 |
| 8,118,015 | B2 * | 2/2012 | Tran | F41B 11/53 124/51.1 |
| 2005/0274371 | A1 | 12/2005 | Lubben | |
| 2007/0256676 | A1 | 11/2007 | Orvis et al. | |
| 2012/0285434 | A1 * | 11/2012 | Andersen | F41A 9/02 124/51.1 |

OTHER PUBLICATIONS

International Preliminary Report on Patentability for International Application No. PCT/EP2016/055991, dated Sep. 28, 2017.

* cited by examiner

PAINTBALL BACKPACK FOR STORING, TRANSPORTING, AND/OR CONVEYING PROJECTILES, AND METHOD FOR CONVEYING PROJECTILES

RELATED APPLICATIONS

This application is a national stage filing under 35 U.S.C. § 371 of international PCT application, PCT/EP2016/055991, filed Mar. 18, 2016, which claims priority to German patent application, DE 10 2015 104 004.2, filed Mar. 18, 2015, each of which is incorporated herein by reference in its entirety.

The invention relates to a paintball backpack for storing, transporting and/or delivering projectiles, comprising a storage container for the projectiles and at least one delivery connection for transporting the projectiles, as well as a method for delivering projectiles from a storage container by at least two delivery devices for transferring the projectiles to a device for shooting the projectiles.

It is known that during the sport of paintball, projectiles, usually so-called paintballs containing color, are delivered by a device for shooting the projectiles, wherein paintball is played in particular as a type of team sport in which as a rule two teams meeting one another must solve tasks. It is of decisive significance for the success when playing paintball that the devices for shooting the projectiles of the individual players are supplied uniformly with projectiles at all times if possible so that they can be delivered regularly and without interruption, that is, continuously. It is not desired that a player is not ready to fire due to problems in the loading of the device for shooting the projectiles, or that the player cannot participate for a rather long time in the game because the projectile supply must be filled up or a storage container must be replaced.

Storage containers are known in the prior art which are designated, for example, as a hopper, ammo box, munition container, rotor or loader. The latter are attached as a rule above the device for shooting the projectiles and can usually receive up to a maximum of 300 paintballs. At a delivery speed of up to 45 projectiles per second on the device for shooting the projectiles the result is that such a hopper becomes empty very rapidly during the game. A distinction is made between a gravity hopper and an agitation hopper on the one hand in which the projectiles pass into the into the marker conditioned by gravity or the movement ("agitation") of the hopper, and driven hoppers in which the projectiles driven by motors or compressed air are delivered into the device for shooting the projectiles.

It turned out in the case of gravity hoppers that they tend to clamp and/or form backups of the projectiles as a result of which even a bursting of the projectiles cannot be excluded. In addition, gravity hoppers or agitation hoppers have low delivery rates of a maximum of 12 projectiles per second. The driven hoppers can comprise means which put the hopper into the position of independently avoiding and/or eliminating the formation of backups and clamping of the projectiles, for example by changing a running direction of the motor, and make possible higher delivery rates of the projectiles. However, this disadvantageously reduces the time in which the player can participate in an ongoing game without having to reload. Another disadvantage of the hoppers known from the prior art is that they are attached as a rule above the device for shooting the projectiles, which greatly limits the viewing field of the player. Moreover, the hopper changes the center of gravity of the system consisting of device and hopper conditioned by its awkward shape, which makes the precise delivery of the projectiles difficult and is a hindrance when guiding the device.

Moreover, paintball backpacks or paintball carrier bags are known in the prior art which comprise a storage container in which the projectiles are stored, wherein the projectiles are transported over a delivery stretch to the device for shooting the projectiles and are transferred to it.

DE 199 22 589 A1 describes a storage container for ball-shaped paintball projectiles which is carried by a wearer on a belt at the level of the hip. The transfer of the projectiles to the device for shooting the projectiles takes place in the lower bottom area of the storage container to a flexible delivery hose. The latter is connected to the manual firearm for shooting the projectiles. A disadvantage of the construction of the storage container according to DE 199 22 589 A1 is the long delivery path of the paintball projectiles from the hip of the carrier via the delivery hose to the manual firearm. As a rule the manual firearms are held at shoulder level during the shooting. The long delivery path against the force of gravity requires an elevated pressure on the paintball projectiles in order to continuously supply them to the manual firearm. Especially in the initial area of the delivery hose the elevated pressure can result in a bursting of the paintball projectiles since the first paintballs in the delivery hose are subjected to the pressure of all the other paintballs. Furthermore, the paintball projectiles in the storage container are supplied by a pressure plate with the aid of a compressed spring to the delivery device in the bottom area of the container. The exertion of this pressure can also lead to damage to the paintball projectiles.

WO2007/017830 A2 discloses a device for loading a manual firearm with bullets consisting in particular of PVC. The device comprises in an upper area a storage container for the bullets which is connected by a delivery screw to a collection chamber located underneath it. The bullets are pressed into a flexible hose with the aid of a sliding wall and supplied to the manual firearm. Due to the long delivery path, a high pressure is necessary to this end. Therefore, the device is suitable for delivering fairly stable balls consisting of solid plastic but not for delivering fragile paintballs.

US 2005/0274371 A1 teaches a paintball backpack comprising a storage container. Paintballs are stored in the latter and supplied with the aid of a movable sliding wall to a delivery worm in the lower area of the storage container. The paintballs are transported from the delivery worm via a supply hose to a marker. The delivery of the paintballs takes place in the bottom area of the storage container of the paintball backpack, which is located in the state of use at the level of the hip of the carrier. The marker, on the other hand, is often held at the shoulder level for firing the paintball. In this case the delivery worm must therefore exert a high pressure force onto the paintballs located in the supply hose in order to ensure a continuous loading of the marker. As a consequence, such a high pressure is exerted on the paintballs, in particular in the initial area of the supply hose, that an increased bursting of the paintballs occurs. This can block the delivery system in the area of the supply hose or of the delivery worm, as a result of which the loading of the marker is interrupted.

Therefore, the backpacks known from the prior art have the disadvantage that the delivery stretch is as a rule very long in relation to the size of the projectiles and the pressure conditions are as a result unfavorable for the paintballs. The delivery stretches in the prior art are formed, for example by rigid tubes or movable hoses in which after a certain length pressure conditions unfavorable for the transport of the projectiles arise. The pressure conditions inside the delivery stretch are therefore quite significant for the smooth operation of a paintball backpack of the designated type since the projectiles are preferably so-called paintballs which are also designated in the sense of this invention as paint, paintball balls or colored balls.

It is preferred that the projectiles are colored balls, so-called paintballs, which comprise, for example a gelatin casing and are filled with a mixture of, for example potato starch, vegetable oil and food dye. It can also be preferred that tapioca or food starches from other plants and/or growths are used for the production of the paintballs or that the casing of the paintballs is produced from alginate. The paintballs advantageously consist of materials of a natural origin which are degraded without residue under usual weather conditions in the open air within a few weeks. It is obvious that it cannot be excluded that the paintballs created in this manner burst after a certain pressure acting on them. A paintball backpack would therefore be desirable in which the delivery stretch from the storage container to the device for the delivery of the projectiles is designed in such a manner that the bursting of the paintballs is reliably avoided inside the backpack and/or inside the delivery stretch due to, for example, unfavorable pressure conditions.

Paintball backpacks are known in the prior art which comprise means for the transfer of the paintballs to the device for the delivery of the projectiles in the lower area of the backpack and/or of the storage container. If such a conventional paintball backpack is used by a user and is carried in the customary manner on his back, the result is that the transfer of the paintballs to the device for the delivery of the projectiles takes place, for example in the area of the user's hip. When using a device for the delivery of the projectiles, that is, when playing paintball, the device for the delivery of the projectiles is customarily worn at the level of the shoulder or of the chest of the user, wherein it is preferred that the projectiles are delivered at this level. It is obvious that the transport device of a paintball backpack must be suitable to overcome the difference of the level between the hip area and the shoulder area of a user which results when using a paintball backpack when walking upright. The overcoming of this distance of level while avoiding the occurrence of unfavorable pressure conditions within a delivery stretch is a special technical challenge in the area of paintball backpacks.

Starting from this prior art, the problem of the present invention consists in making available a paintball backpack and a method for delivering projectiles which does not have the deficiencies and disadvantages of the prior art and in particular ensures optimal pressure conditions in a delivery stretch for the projectiles from the storage container to the device for shooting the projectiles.

The problem is solved according to the invention in that a paintball backpack is made available for storing, transporting and/or delivering projectiles as well as at least one delivery connection for the transporting of the projectiles, wherein the paintball backpack comprises a first delivery device preferably in a bottom area of the storage container and at least one second delivery device preferably in a head area of the storage container, wherein the first delivery device and the at least one second delivery device are arranged superposed over each other in and/or on a storage container and are connected to each other by the at least one delivery connection and that the storage container in the head area comprises an opening for transferring the projectiles to the device for shooting the projectiles.

It is preferred that the storage container for the projectiles of the paintball backpack according to the invention is integrated in a backpack, wherein the storage container has an inner chamber surrounded by sidewalls, wherein the side of the storage container facing the back of the user is preferably designated as the back wall or back side and the side facing away from the user is designated as the front side of the storage container. It is preferred that the sidewalls are manufactured from stable plastic and reliably prevent an undesirable exiting of the projectiles from the storage container. It can also be preferred in the sense of the invention that the side walls of the storage container are designed to be padded. The sidewalls preferably have plastics selected from the group comprising acrylonitrile-butadiene-styrene (ABS) and/or polycarbonates (PC).

The concept "superposed on one another" preferably means in the sense of the invention that the two delivery devices are present preferably arranged at different levels inside the storage container. The lower area, which is arranged during the carrying of the paintball backpack preferably at the level of the user's hip, forms a bottom area of the storage container in which the first delivery device is preferably provided. Therefore, the bottom area of the storage container preferably denotes the area of the storage container which is located during the carrying of the paintball backpack at the level of the hip or at the lower back area of a user. It is preferred that the bottom area of the storage container designates the lower third of the storage container, especially preferably the lower fifth of the storage container. The second delivery device preferably lies in a head area of the storage container and/or of the paintball backpack. It is preferred that the head area of the paintball backpack is at the shoulder level and/or at the neck level of the user when being carried. Therefore, in the sense of the invention the head area of the storage container of the paintball backpack preferably denotes the area of the storage container which is located on the shoulder, the neck, the upper back area and/or the head of a user when carrying the paintball backpack. It is preferred that the head area of the storage container of the paintball backpack designates the upper third, especially preferably the upper fifth of the storage container of the paintball backpack. It results from these preferred designations for an upper head area and a lower bottom area of the storage container that the arrangement of the delivery devices "above each other" is to be understood in such a manner that one of the at least two delivery devices is preferably provided at a different level than an at least second delivery device. These different levels preferably extend from the bottom area to the head area of the storage container. The described arrangement of the at least two delivery devices is also preferably designated in the sense of the invention as "horizontally above each other".

Furthermore, in the sense of the invention the concepts "above", "upper" or the like preferably designate those areas or structural components of the paintball backpack which are further removed from the ground when the paintball backpack is carried on the back of a standing carrier. Furthermore, in the sense of the invention the concepts "below", "lower" or the like preferably designate those areas or structural components of the paintball backpack which are closer to the ground when the paintball backpack is carried on the back of a standing carrier. The definitions of the concepts "above" and "below" in the sense of the invention therefore preferably correspond to the meaning defined by gravity for a certain orientation of the paintball backpack. The concepts "above" and "below" of the paintball backpack refer to the orientation which the paintball backpack has when carried on the back of a standing carrier. This is preferably designated as a standing paintball backpack. An upright-oriented paintball backpack is shown, for example, in FIG. 1. In the standing position of the paintball backpack an upper area is also "up" in the sense of gravity. Of course, it is apparent to a person skilled in the art that if the paintball backpack is placed flat on the ground, the "upper area" or "head area" of the paintball backpack is no longer "up" in the sense of gravity but rather, for example, points to the front or to the side.

Moreover, the concepts "higher", "over", "over it", "deeper", "lower", or "under it" are preferably understood in the sense of the invention as relative positions along the orientation of the paintball backpack, which follow from the definition of upper areas or head areas versus lower areas or bottom areas. Likewise, therefore, a "difference of level" in the sense of the invention preferably concerns a distance between a first area or structural member of the paintball backpack which is located "above" a second area or structural member of the paintball backpack.

The at least one delivery connection for transporting the projectiles is preferably at least one tube and/or a stable or rigid hose which is preferably arranged in the spatial vicinity of one of the side walls of the storage container and connects a first delivery device to the at least one second delivery device. However, it can also be preferred that the delivery connection is arranged centrally in the storage container of the paintball backpack or is run outside of the storage container.

The first delivery device preferably lies in the bottom area of the storage container of the paintball backpack in accordance with the invention. The lower area of the storage container is preferably formed like a funnel in such a manner that oblique planes directed downward from the sidewalls of the inner chamber of the storage container empty into a delivery device arranged in the middle of the lower area of the storage container. The concept "in the middle" preferably refers here to the vertical arrangement of the first delivery device in the sense that the vertical position of the first delivery device preferably corresponds to the position of the spine of the user of the paintball backpack according to the invention. The paintballs, which are located in the inner chamber of the storage container of the paintball backpack in accordance with the invention, are advantageously conducted through the construction of the lower area of the inner chamber of the storage container by the oblique planes to the first delivery device, which transports them to the at least one second delivery device. It can also be preferred for individual other applications that the first delivery device is not present in the middle of a bottom area of the storage container but rather at a lesser distance from one of the sidewalls than it does to another sidewall. The at least two delivery devices could also be present outside of a storage container of the paintball backpack.

It is preferable that the at least one second delivery device is arranged horizontally above the first delivery device, wherein it is also arranged in the vertical sense in the middle of the storage container. It is preferred in the sense of this invention that the second delivery device is provided in such a manner that it is preferably located in an upper head area of the storage container so that a transport of the projectiles is made possible from a lower bottom area to an upper head area of the storage container by the delivery connection. If two delivery devices are used, the transfer of the projectiles from the paintball backpack of the invention to the device for shooting the projectiles preferably takes place from the second delivery device to the device for shooting the projectiles. The concrete construction of this transfer will be further explained in the further course of this specification.

If more than two delivery devices are used, it is preferred that the additional delivery devices are arranged, for example, in intermediate planes inside the storage container. Furthermore, it is preferred that the at least one delivery connection can be arranged inside the storage container. However, it can also be preferred for other usages that the at least one delivery connection is present outside of the storage container. As a result, the space available for the projectiles is advantageously increased, as a consequence of which more projectiles find space in the storage container.

Furthermore, it can be preferred that the paintball backpack according to the invention comprises more than two delivery devices, wherein one delivery device is preferably arranged in the lower bottom area of the storage container and the second delivery device is arranged in the upper head area of the storage container. Additional delivery devices can be arranged, for example, centrally between this first and this second delivery device. It was completely surprising that by using at least two delivery devices in conjunction with the paintball backpack according to the invention the delivery stretch for the projectiles, preferably the paintballs, can be significantly shortened and that in particular the transport of the projectiles takes place in a protected inner chamber of the storage container in surprisingly stable delivery connections. Therefore, a first delivery path of the paintball balls preferably takes place in a protected manner inside the storage container. The difference of level inside a stable, preferably vertical delivery tube is overcome in this first delivery path from the first delivery device in the bottom area of the storage container to the second delivery device in the head area of the storage container. On the second delivery path from the opening to the transfer of the projectiles to the device for shooting the projectiles no or only a slight difference of level must now be overcome for the transporting of the paintball balls. The preferred division of the delivery paths has the result that an undesirable creation of unfavorable pressure conditions inside the delivery connections can be prevented. In particular, in this manner an undesirable deformation or a bursting of the paintball balls can be effectively avoided.

The paintball backpack is especially suited for delivering fragile projectiles on account of the compensated pressure conditions. Therefore, the projectiles are preferred paintballs in the sense of the invention which comprise, for example, a casing filled with liquid dye. It can also be preferred that the projectiles are so-called powder balls which have a casing filled with powder, for example colored powder. Whereas the paintball backpack is especially suited for the delivering of fragile projectiles, the paintball backpack can also be advantageously used to deliver solid projectiles or balls such as, for example Reballs, hard rubber balls or also ceramic balls. In the sense of the invention the concepts projectiles, paintballs or also paintball projectiles are used preferably synonymously. Therefore, in the sense of the invention the paintball backpack preferably designates a device which can be carried like a backpack or a shoulder bag, comprises a storage container and is suitable for storing and delivering projectiles and transferring them to a device for shooting projectiles such as, e.g. a marker. Therefore, in the sense of the invention the concepts paintball backpack, backpack, carrying bag or also loading backpack are preferably used synonymously.

Furthermore, it can be especially preferred that the distance of level between the first delivery plane and the second delivery plane is between 15 cm and 60 cm, especially preferably between 25 cm and 45 cm. This delivery path between the first delivery device and the second delivery device results in especially advantageous pressure conditions for the transport of paintballs. This is especially the case for the transportation of paintballs with a caliber between 10 mm and 20 mm.

In another preferred embodiment the storage container of the paintball backpack has a height between 25 cm and 80 cm, preferably between 35 cm and 60 cm, a width between 20 cm and 50 cm, preferably between 25 cm and 35 cm and a depth of 8 cm to 40 cm, preferably between 12 cm and 25 cm. The height of the storage container preferably corresponds to its extension from the uppermost end to the lowest end, i.e., to the dimension along the axis of the carrier's body when the paintball backpack is being carried on his back. The width preferably corresponds to the extension relative to the orientation in the carrying state from right to left and the depth preferably corresponds to the extension relative to the orientation in the carrying state from the front side to the back side. The dimensions cited with preference allow, in comparison to the prior art, the stowing of a rather large number of paintballs. As a consequence, the carrier can shoot shots for a rather long time period without having to charge the storage container. In addition, it was surprising that an especially stable and rapid transportation of paintballs is possible with the preferred cited dimensions in combination with the arrangement of the delivery devices in accordance with the invention. This is a departure from the prior art. Therefore, a person skilled in the art started from ensuring a more stable and more rapid delivery of paintballs for the compact storage container. On the other hand, the combination of the arrangement of delivery devices in a head area and in a bottom area of the storage container with the cited dimensions surprisingly leads not only to an enlarging of the reservoir for the projectiles but also to a more reliable transporting of the paintballs even at high delivery speed due to the effect on the pressure conditions.

It is preferred that the transporting of the projectiles takes place inside the inner space of the storage container by a delivery connection, wherein the delivery connection is preferably formed by tubes and/or stable and rigid hoses. It can be preferred in the sense of this invention that the paintball backpack of the invention has such a delivery connection preferably arranged in the area of a side wall of a storage container, or it can also be preferred that several such delivery connections are provided. These several delivery connections can preferably be arranged in a side wall of the storage container or on different side walls of the storage container. It can also be preferred that the delivery connections are in a back side of the storage container which side preferably faces the back of a user of the backpack of the invention or in a front side of the storage container which preferably is on a side of the paintball backpack which faces away from the user.

Another effective protection of the paintball to external actions is ensured by using in particular stable delivery connections which are additionally arranged in the protected inner space of the storage container. In particular, the combination of a shorter delivery stretch with a surprisingly stable construction of the delivery connection makes it possible that, for example, no loops and bends form in the delivery connections which could result, for example, in blockages in the delivery stretch and further the bursting of the paintballs.

Furthermore, it was completely surprising that a paintball backpack according to the invention can be made available in which the transfer of the paintballs to the device for shooting the projectiles takes place in the head area of the paintball backpack, which area preferably corresponds to a neck and/or shoulder area of the user. Paintball backpacks are known in the prior art in which the projectiles exit, for example at the hip level of the user, that is, in the bottom area of the paintball backpack, in order to be transported to the device for the shooting of the projectiles. When using such conventional backpacks a difference of level, for example between the hip and the shoulder of a user, must be overcome. This poses a technical challenge in as far as that the projectiles should be continuously transported at a high speed in order to make possible the uniform shooting of the projectiles by the device provided to this end.

The construction according to the invention of the transfer of the projectiles preferably at the shoulder level of the user makes it possible in an advantageous manner that the transfer of the projectiles takes place at the same level as the shooting of the projectiles. Now that no difference in level must be overcome any more by the using of the device according to the invention, a surprisingly rapid and efficient transfer of the projectiles is made possible. Tests have shown that the number of undesirable misfires can be considerably reduced by the preferred transfer of the projectiles in a head area of the paintball backpack of the invention.

A misfire results from the fact that a delivery gap is created in the clocked delivery of the projectiles through the preferably two delivery devices. This can occur, for example, in that during the receiving of the projectiles by one of the delivery devices a place remains unoccupied in a delivery pocket of the delivery devices, or in that a paintball bursts in the delivery device or in the delivery connection. It was completely surprising that the number of misfires can be reduced to such a surprisingly high degree by using the paintball backpack of the invention.

It was also surprising that the manner of constructing the paintball backpack results in advantageous pressure conditions even when the device for shooting the projectiles is positioned at the hip level or vertically over the head. In the case of a shot level at the level of the hip the paintballs are advantageously transported down from the opening for transferring the projectiles in the head area of the paintball backpack. In this case the force of gravity supports the transporting of the paintballs in the delivery hose instead of counteracting it. This reduces the pressure required for transporting the paintballs. If the device for shooting the paintballs, e.g., a marker, is held vertically over the head, a difference of level from the opening for transferring the projectiles in the head area to the lower end of the marker must preferably be overcome. However, this difference in level is distinctly less that it is in the prior art. Whereas in the prior art a firing of paintballs over the head regularly leads to misfires, it was completely surprising that in the paintball backpack according to the invention misfirings can be effectively avoided even when holding a marker over the head in order to shoot vertically upward. Therefore, the construction of the paintball backpack according to the invention surprisingly allows a reliable loading of a marker independently of its positioning. In contrast to the prior art, a marker loaded with the paintball backpack can be used continuously and without limitations.

A device for shooting the projectiles is preferably designated in the sense of this invention as a marker or as a launcher. This preferably concerns a compressed air weapon which is suitable for firing projectiles, in particular paintballs, at a rate of up to 45 paintballs per second. For this a highly compressed gas is preferably used to accelerate the paintballs, for example in a barrel of the marker. It is preferable that in the sense of this invention mechanical and/or electro-pneumatic markers are concerned. Mechanical markers are preferably characterized in that a trigger mechanism is released by actuating a trigger guard, as a result of which, for example, a gas standing under pressure releases the firing of a paintball through a valve. In an electro-pneumatic marker the mechanical trigger is preferably replaced by an electronic control and check of the firing of the shot. It is preferred when using an electro-pneumatic marker that the trigger activates a microswitch, magnetic switch and/or an optical switch, wherein this switching information is preferably forwarded to an electronic circuit which assumes the control of the gas currents and the release of the shot, preferably by a magnetic valve. A rapid and surprisingly precise firing of the paintball is advantageously achieved by using an electro-pneumatic marker. In particular, the using of electro-pneumatic markers also makes it possible to use readily bursting paintballs which are used, for example, when performing tourneys.

It is preferred that the compressed air for firing the projectiles is made available by a gas system which preferably consists of a pressure tank and a pressure reducer fastened to it. It is preferred that the pressure tank contains the compressed gas which, for example, accelerates the paintballs in the barrel of the marker. It is furthermore preferable that the compressed gas is selected from the group comprising compressed, liquid carbon dioxide, compressed air and/or propane. It is furthermore preferable that the holding capacity of the pressure tank is in a range between 0.5 and 2 liters, especially preferably between 0.7 and 1.8 liters and most preferably between 0.8 and 1.1 liters. It is furthermore preferred that the pressure tank consists of aluminum alloys, composite fiber materials or a combination of these materials. It is furthermore preferred that the compressed gas is present with a pressure of preferably 200 to 300 bar in the pressure tank. A preferred muzzle velocity of the paintballs when leaving the barrel of the marker in the range of 280 to 330 km/h results from the cited parameters.

The diameter of the projectiles, here of the paintballs, is preferably designated as the caliber in the sense of the invention. The diameter of the projectiles preferably corresponds to the inside diameter of the marker barrel. It is preferred that the projectiles for the paintball backpack according to the invention have calibers in the preferred range between 10 and 20 mm, wherein the caliber of 17.3 mm is especially preferred. It was especially surprising that the delivery of projectiles with the previously cited, preferred calibers with the aid of the teaching of the invention is especially advantageous. Therefore, very few miss firings occur in a paintball backpack according to the invention which is provided with the preferably cited calibers. In addition, the loading of a marker can take place in this preferred embodiment with especially high rates without paintballs being damaged.

In another preferred embodiment of the invention the at least one second delivery device comprises a storage plane, wherein the storage plane serves for an intermediate storage of the projectiles and the second delivery device is connected to the opening for transferring the projectiles by a delivery connection. It is preferred that the delivery devices comprise rotors which make possible a clocked receiving and delivery of the projectiles. The clocking of the receiving and/or of the delivery results from the fact that the rotors preferably comprise delivery pockets into which the projectiles fall. It is preferred that the rotors forming the delivery device comprise a preferred number of 2 to 30 delivery pockets. It is furthermore preferred that in particular the second delivery device above the rotor comprises a storage plane and that the storage plane is formed by a side wall and/or that the storage plane is formed by a funnel-shaped intermediate plane. The delivery devices and/or the rotors preferably have a circular base surface area. It is preferred that the side wall imitates the outer shape of the delivery device and/or of the rotor so that the storage plane also preferably has a circular structure in whose inner space an intermediate storage of the projectiles takes place. The projectiles, which are transported by the at least one delivery connection from the first delivery device into the area of the at least one second delivery device, pass into this inner chamber serving for intermediate storage and which is preferably designated as a storage plane in the sense of the invention. An especially advantageous intermediate storage of the paintballs is made possible by the storage plane. The paintballs are transported upward in the delivery connection from the first delivery device to the second delivery device. At this time the paintballs are preferably pushed by the pressure force of the first delivery device. In the preferred variant the paintballs reach the storage plane of the second delivery device. Advantageously no pressure is exerted on the paintballs on the storage plane. Instead, the storage plane makes possible an intermediate storage of the paintballs by which damage to the paintballs can be avoided even more effectively. From the storage plane the paintballs preferably pass due to gravity to delivery means, preferably to the delivery pockets of the delivery device. Therefore, an active transport is advantageously not necessary. It was surprising here that the forwarding of the paintballs to the second delivery device, which preferably comprises delivery pockets, can also take place with a high throughput in a steady and continuous manner by a storage plane. In the prior art sliding walls or compression springs are used as equipment in delivery devices. This is advantageously no longer necessary on account of the intermediate storage with the aid of a storage plane as part of the second delivery device. In addition, it was surprising that an especially simple and secure transport of the paintballs can take place from the second delivery device with the aid of a delivery connection to the opening for the transfer of the projectiles to the device for shooting the projectiles. Therefore, it can be preferred that the second delivery device is located at the same level and/or at a higher plane than the opening. As a consequence, the transport of the paintballs from the second delivery device to the opening is advantageously supported by gravity and can take place in an especially frictionless and reliable manner.

Furthermore, it is preferred that the at least one storage plane is arranged in a head area of the storage container and is surrounded by a side wall and/or is formed by a funnel-shaped intermediate plane.

Furthermore, it is preferred that the storage plane and the at least one second delivery device are arranged in a head area of the storage container of the paintball backpack of the invention. Other delivery devices are preferably present as funnel-shaped intermediate planes in the and/or on the storage container and are advantageously used to shorten the delivery stretch between the delivery devices, which makes possible a more reliable and continuous transport of the projectiles. The funnel-shaped intermediate plane is preferably formed by oblique planes on which the projectiles are guided preferably to a lowest point of the intermediate plane which can form, for example, a floor within the storage container.

It was completely surprising that as a result of the preferred intermediate storage of the projectiles in a storage plane which is arranged in the head area of the storage container and/or is formed by a funnel-shaped intermediate plane the number of misfirings can be considerably lowered, which considerably improves the firing efficiency of projectiles by the device for firing the projectiles, for example, a marker. Moreover, this constitutes a diversion from the prior art since the professional world previously started from the fact that, conditioned by gravity, the delivery of the projectiles from a paintball backpack must take place in the lower area of the paintball backpack. It was completely surprising that this delivery of the projectiles can also take place in the head area of the paintball backpack according to the invention.

It was furthermore completely surprising that as a result of using a storage plane and/or an intermediate plane in accordance with the invention a surplus can be made available for the projectiles available for the second delivery device for the further transport. A surplus in the sense of this invention is preferably an excess of projectiles for the at least one second delivery device. The delivery of the projectiles by the at least one second delivery device preferably takes place in a clocked manner, as a result of which a certain number of projectiles can be delivered further per time unit. A surplus can be created, for example, in that the generation of a surplus is provided in advance, for example, by a controlling, programming and/or the manner of the functioning of the synchronization of the first and at least one second delivery device. It is preferred that the projectiles pass by gravity from the storage plane and/or the intermediate plane into the delivery pockets of the delivery device. However, it can also be preferred for other usages that a direct transfer, which is preferably also designated in the sense of this invention as a "1-to1 transfer", takes place between the at least two delivery devices. This means that transfer means are made available with which individual projectiles are preferably transferred from a delivery pocket of the first delivery device to a delivery pocket of the at least one second delivery device.

In another preferred embodiment an axle for transferring a delivery force connects the first and at least one second delivery device to each other in such a manner that an operation of the at least two delivery devices can be synchronized. It is preferred that when using the paintball backpack according to the invention the at least two delivery devices cooperate in a synchronous manner. If the at least two delivery devices do not operate in synchrony, undesirable backup effects and/or a bursting of the paintballs can occur. It is preferred in the sense of the present invention that the delivery devices comprise drive means for generating a delivery force, wherein a delivery force is transmitted to the delivery devices by these drive means by means of which force the transport and/or the delivery of the projectiles takes place.

In another preferred embodiment of the invention the at least two delivery devices comprise rotors, delivery worms, delivery chains and/or drive means for generating a delivery force, wherein the drive means for generating a delivery force are selected from a group comprising at least one electromotor, an internal combustion engine and/or a device for generating compressed air.

In the sense of the invention the concept rotor preferably designates a turning and/or rotating component of a transport. A rotor can comprise, for example, a circular base surface, wherein preferably delivery pockets are present on a partial circle of the rotor into which, for example, the projectiles fall conditioned by gravity. It can also be preferred in the sense of the invention that the rotor comprises means suitable for moving the projectiles into the delivery pockets.

In the sense of the invention the concept delivery worm preferably designates a delivery device for the projectiles which is based on the functional principle of the Archimede's screw. It is preferred that the delivery worm is driven with the drive means. It can also be preferred for a few applications that different delivery alternatives, for example, delivery connection and delivery worm, are used combined with each other. The using of a delivery worm advantageously makes possible a surprisingly uniform delivery of the projectiles.

It can also be preferred in the sense of the invention that the delivery devices are formed by a delivery chain. In the sense of the invention a delivery chain is preferably a mechanical system which is advantageously used to deliver the projectiles. The using of a delivery chain preferably makes possible a continuous mechanical delivery of the projectiles, wherein a horizontal, vertical or diagonal delivery of the projectiles is advantageously made possible. It is furthermore preferred that these different delivery methods are combined with each other. This is especially advantageous when the firing of the projectiles takes place not only when standing but also when the user of the paintball backpack is, for example, lying or is bending forward or backwards. A delivery chain advantageously represents a space-saving delivery possibility which can be adapted into the paintball backpack of the invention in a surprisingly simple manner on account of its three-dimensional construction.

It is furthermore preferred that the at least two delivery devices are connected by an axle so that a synchronization of the at least two delivery devices is achieved by the rigid connection of the at least two delivery devices. The connection of the at least two delivery devices by a rigid axle, which can be formed, for example, by a metallic rod, is a simple mechanical measure which can be readily implemented in the manufacturing process in order to ensure a surprisingly effective, long-lasting and low-maintenance synchronization of the at least two delivery devices. It was surprising here that delivery backups or misfires can be especially effectively eliminated by the axle. In addition, the mechanical synchronization surprisingly reduces the expenditure of energy for driving the delivery system.

In another preferred embodiment of the invention the paintball backpack according to the invention comprises drive means for generating a delivery force, wherein the drive means are selected from a group comprising at least one electromotor, an internal combustion engine and/or a device for generating compressed air.

The concept "electromotor" designates in the sense of this invention an electromechanical converter which converts electrical energy into mechanical energy. It is preferred that a force which is exerted, for example, by a magnetic field on a conductor through which current flows in a coil is converted into movement. Electromotors advantageously generate rotating movements as a result of which the rotary movement of the rotors for delivering the projectiles is advantageously driven in the present invention.

In the sense of this invention the concept "internal combustion engine" denotes an internal combustion machine in which chemical energy is converted into mechanical work of the combustion of a fuel. To this end a combustible mixture of fuel and air is customarily burned in a combustion chamber, wherein pistons are preferably moved by the thermal expansion of the hot gas being produced. The concept "device for the production of compressed air" describes in the sense of this invention a device with which compressed air is made available for the transporting of the paintballs. Tests have shown that in particular the using of at least one electromotor results in optimal delivery results and that the electrical energy for operating the at least one electromotor can be readily ensured by the inclusion of batteries and/or accumulators.

In another preferred embodiment of the invention the storage plane of the at least one second delivery device, which is arranged in a head area of the storage container and/or is formed by a funnel-shaped intermediate plane, comprises an overflow device. The overflow device is preferably formed by an opening in the side wall of the support plane and/or by an opening in one of the oblique planes which form the funnel-shaped intermediate plane. It is preferred in the sense of this invention that the paintballs are transported by a delivery connection from a first delivery device preferably arranged below an at least second delivery device into the storage plane of the at least one second storage device and/or into the funnel-shaped intermediate plane. In this storage and/or intermediate plane the projectiles can be preferably temporarily stored in order to keep a reserve of a supply of projectiles, with which a surprisingly regular and continuous supplying of the second delivery device with projectiles can be ensured.

It was completely surprising that in particular backup effects in the delivery connection between the first and at least second delivery device can be effectively avoided by the overflow device of the invention if paintballs, for example, cannot be delivered or not fast enough. Therefore, the overflow device of the invention effectively prevents an undesired bursting or clamping of the paintballs.

It was completely surprising that an overflow device with such a simple mechanical solution such as an opening in a side wall of the support plane can be made available which favors the continuous delivery of the paintballs in such a surprising manner. In addition, the support plane and according to the invention and comprising an overflow device is a departure from the prior art because the professional world previously started from the fact that the transfer of objects to be transported between at least two delivery devices functioned especially well if the direct transfer from the first to the second delivery device takes place. As a result of the intermediate insertion of a storage plane comprising an overflow device provided according to the invention, a solution purposely deviating from the prior art is suggested which is delimited from conventional delivery chains in an inventive manner.

It is preferred in the sense of the invention that paintballs can exit from the opening in the side wall of the support plane if the volume of the support plane is not sufficient to receive other paintballs. The paintballs preferably fall through the opening in the side wall of the support plane back into the storage container of the paintball backpack according to the invention. When using more than two delivery devices the use of overflow devices of the invention in each delivery device, which is preferably provided above a first delivery device, is conceivable. It was completely surprising that the making available of overflow devices in each storage plane and/or intermediate plane of an at least second delivery device can effectively avoid backup effects in each partial delivery stretch.

In another preferred embodiment of the invention the first delivery device comprises a motor and a mechanical safety coupling, as a result of which, when a maximum delivery force is exceeded, the delivery of the projectiles is decoupled from the motor movement. The mechanical safety coupling is preferably located to this end below the first delivery device. In an especially preferred embodiment the mechanical safety coupling comprises an outer, cogged coupling ring in which a coupling gear is present, wherein the arms of the coupling gear run radially outward and engage into the cogs of the outer coupling ring. It is preferred that a motor brings about a rotary movement of the outer coupling ring. The movement off the outer coupling ring rotates the inner coupling gear and drives the first delivery device. For example, in this "coupled" state a rotary movement of the rotor comprising the delivery pockets is brought about and the projectiles are transported from the first delivery device to the second delivery device. If a backup of the projectiles should occur during the transport or, however, some other disturbance should be present which results in an elevated force for the transporting of the projectiles, the motor movement of the delivery of the projectiles is advantageously decoupled by the mechanical safety coupling. I.e., the motor continues to rotate and therefore also the outer cogged coupling ring. However, due to the elevated force and the elevated torque which is necessary for driving the inner coupling gear, a coupling of the cogging nevertheless occurs and the arms slide over the outer coupling ring. In this decoupled state the outer coupling ring rotates but the inner coupling gear stands still and with it the delivery of the projectiles. The bursting of the projectiles during a backup can be advantageously and effectively avoided by the force-dependent and torque-dependent decoupling. Instead, an excess of pressure on the projectiles is counteracted as soon as the maximum delivery force is exceeded. In the sense of the invention the maximum delivery force preferably designates that maximum force or that maximum torque at which the drive of the motor and the means for delivering the projectiles, for example, a rotor comprising delivery pockets, are still mechanically coupled to one another. If the maximum delivery force is exceeded, a decoupling occurs as described above. The preferred embodiment of the mechanical safety coupling comprising an outer coupling ring and an inner coupling gear is especially advantageous since a maximum delivery force can be set based on the material qualities, the number of arms or the depth of the cogging. Given a greater number of arms and a more rigid material, for example the maximum delivery force can be increased. On the other hand, a reduction of the number of arms or, however, of the rigidity of the material results in a reduction of the maximum delivery force. The maximum delivery force can advantageously be adapted to the qualities of the projectiles by the preferred designing of the mechanical safety coupling. Thus, as a rule it is preferred to set a lower maximum delivery force for especially fragile projectiles such as, e.g. fragile paintballs that is the case for less fragile projectiles. However, a person skilled in the art recognizes that even other designs of the mechanical safety coupling are possible which avoid a bursting of paintballs during a backup. It was surprising that the bursting and/or damaging of paintball projectiles can be avoided in an especially simple and effective manner by making available a mechanical safety coupling which allows a maximum delivery force.

In another preferred embodiment the paintball backpack comprises an electronic control unit. It is especially preferred here that the electronic control unit is a printed circuit board (PCB). It is advantageously possible with the aid of the electronic control unit, preferably of the PCB, to automatically control the functions of the paintball backpack and adapt them to occurring challenges. Various options can be controlled with the aid of the electronic control unit. On the one hand, it can be preferred that the PCB controls the motor movement on the basis of a light barrier signal and therefore optimizes the delivery of the projectiles as needed. Furthermore, it can be preferred that the PCB controls the illumination means for displaying operating states of the paintball backpack. As a consequence thereof, it is preferably displayed to the user whether the paintball backpack is ready for operation or whether a disturbance, e.g., of the delivery device is present. Furthermore, the energy supply from the battery of the paintball backpack can be distributed onto the particular consumers (e.g., light barrier, an electromotor or illumination means), preferably with the aid of the PCB. In addition, it can be preferred that the PCB converts the voltage level of the charging power pack in order to achieve a required battery charging voltage.

Furthermore, it is possible in an especially preferred embodiment to operate the motor as a function of the coupling state with the aid of the electronic control unit. Therefore, it is especially preferred that it can be determined with the aid of the electronic control unit whether the motor and the drive of the delivery device for delivering the projectiles are decoupled and are therefore in neutral. After a set neutral time, for example, after 1 second, 2 seconds or also after 10 seconds it is preferred that the PCB stops the motor. This has a positive effect on the energy balance. Furthermore, it is especially preferred that the motor is controlled "backwards" following a stopping of the motor with the aid of the electronic control unit. Backwards preferably designates a running direction of the motor which is opposite to the delivery direction. This is preferably designated as the "reverse" of the motor and preferably lasts for a time period of 0.5-10 seconds. A backup of projectiles can be surprisingly and effectively solved by putting the motor in reverse. After the running in reverse the electronic control unit preferably initiates a running in a forward direction of the motor. If the backup has not yet been cleared and therefore the maximum delivery force is being exceeded, the coupling function and the motor and the projectile delivery are decoupled and the delivery device is in neutral. After a neutral time the motor would be switched back into reverse. This procedure has proven to be especially effective for loosening backups of projectiles in the paintball backpack. Furthermore, it is preferred that the neutral time and the reverse time are optimized for different projectiles. It was surprising here that an especially trouble-free delivery of different projectiles is achieved with the aid of such an electronic safety coupling in cooperation with a mechanical safety coupling. Furthermore, it is preferred that the PCB sets a maximum number of iterations. If the PCB determines that, e.g. the backup has not been cleared after the third reverse running, the PBC preferably shows a display on the illumination means which shows the user that there is a problem. The user can then, if necessary, loosen the backup of the projectiles in the storage container with the aid of manual movements.

In another preferred embodiment of the invention a guide structure consisting of two oblique planes is arranged inside the storage container, wherein the two oblique planes are connected to one another in such a manner that they form a rounded-off connection edge with one another in an upper area of the storage container which constitutes a plateau area of the guide structure, wherein the projectiles are guided from this plateau area by the two oblique planes in the direction of a head area of the storage container and/or in the direction of the first and/or of another delivery device.

It is preferred that the plateau area of the guide structure is on the side facing away from the back of the user of the paintball backpack according to the invention, that is, in the front area of the storage container. It is furthermore preferred that the two oblique planes forming the guide structure with one another extend from the rounded-off connection edge forming the plateau area of the guide structure in the direction of the back side of the storage container and empty into this back side of the storage container by a transitional area which is also rounded off. As a result of this preferred design of the guide structure a guiding of the projectiles in the direction of the back side of the storage container is effectively made possible. It was completely surprising that the making available of a guide structure in the inner space of a storage container of the paintball backpack according to the invention makes possible an effective supplying of projectiles into a delivery area and/or taking-in area of the first delivery device which is especially significant when the user of the paintball backpack according to the invention fires the projectiles by the device for firing the projectiles when lying.

When shooting when lying the paintball backpack of the invention is aligned substantially parallel to the ground on which the user of the backpack is lying. The concept "substantially" is not an unclear concept for the average person skilled in the art because he knows that, for example, when the user is supported on his elbow when shooting when lying, a small angle is formed between the back side of the storage container of the paintball backpack of the invention and the ground. It is preferred in the sense of this invention that a small angle in the range between 0 and 30° is designated as "substantially" parallel.

If no guide structure according to the invention were provided in the interior of the storage container, the projectiles in the interior of the storage container would be present on the back side of the storage container, conditioned by gravity. As a consequence, in particular the supplying of the projectiles to a delivery area of the first delivery device would become considerably more difficult and impaired. A delivery area in the sense of this invention is the area directly above a first delivery device from which projectiles fall conditioned by gravity into the delivery pockets of a rotor, forming, for example the delivery device. It is also preferred in the sense of this invention to designate the delivery area of the first delivery device as the taking-in area, wherein these two designations are used synonymously.

It is especially preferred that the oblique plane which faces the first delivery device and which is designated in the sense of this invention as the lower, oblique plane, has a greater length than the upper, oblique plane. Furthermore, it is preferred that the guide structure consisting of two oblique planes has its plateau area approximately centrally in the horizontal sense in the interior of the storage container, and that the guide structure is present on the whole in the lower two thirds of the interior of the storage container of the paintball backpack according to the invention. Therefore, it is preferred that the plateau area characterizes a boundary between an upper area of the storage container in which the second delivery device is located and a lower area of the storage device in which the first delivery device is located. The head area of the storage container in which the opening for transferring the projectiles is located is part of the upper area. The head area of the storage container in which the first delivery device is preferably located is part of the lower area.

In another preferred embodiment of the invention the paintball backpack comprises a carrier system to which belts for carrying the paintball backpack are attached. The carrier system is preferably attached to the outside of the back side of the storage container. To this end the carrier system can be fastened, for example, with the aid of belts to eyelets of the storage container. The belt lengths can preferably be adjusted and can be adapted to the body structural conditions of the user. It is especially preferred in the sense of the invention that two belts are provided for a user for carrying the paintball backpack of the invention. Furthermore, it is preferred that the outer back side of the carrier system is provided with pads which advantageously increase the carrying comfort of the paintball backpack. In addition, it can also be preferred in the sense of the invention that the paintball backpack comprises a belly belt which can be preferably closed with a clamping closure consisting of a female and a male closing part or, however, with the aid of a broad Velcro closer. It was completely surprising that the making available of such a belly belt can significantly increase the carrying comfort of the paintball backpack of the invention because a narrower resting on the back of the user is advantageously made possible as a consequence.

In another preferred embodiment of the invention the second delivery device, which is arranged in the head area of the storage container, can be attached to a device for firing the projectiles by another delivery connection, a connection means and/or a movable guide means for transporting the projectiles. The device for firing the projectiles can advantageously be a marker. It is preferred that the other delivery connection is, for example, a tube which runs from the output of the second delivery device to a connection means. This connection means is in the sense of the invention preferably an adapter which is preferably designed with two parts and comprises a threading. It is preferred that a movable guide means of transporting the projectiles can be fastened to a device for firing the projectiles in a surprisingly firmly seated manner by the bipartite construction of the connection means, which comprises a threading. It was completely surprising that the using of a bipartite threading can make possible a surprisingly stable and in particular tear-resistant fastening of the movable guide means on the storage container.

It is preferred in the sense of the invention that the movable guide means for transporting the projectiles is designed as a hose which comprises, for example, individual ribs and as a result reacts especially flexibly to movements of a user. It was completely surprising that the using of the preferably bipartite connection means preferably comprising a threading makes possible a ready replacement of the movable guide means.

In another preferred embodiment of the invention the length of the movable guide means can be variably adapted to body prerequisites of the user of the paintball backpack of the invention. Tests have shown that an individualizing of the length of the movable guide means has significant influence on the optimal delivery of the projectiles since in the case of a non-optimal length, unnecessary curves and loops can arise in the movable guide means. It was completely surprising that, among other things, the ready ability to replace the movable guide means makes it possible to adapt the length of the movable guide means in an uncomplicated and rapid manner to, for example, different body sizes and arm lengths of the user of the paintball backpack of the invention. The individual ability to adapt the length of the movable guide means advantageously achieves an optimization of the stability of the delivery.

In another preferred embodiment of the invention the device for firing the projectiles comprises illumination means for displaying operating states of the paintball backpack. It is preferred that the device for firing the projectiles, for example, a marker, has an attachment which comprises a connection means which serves to receive the movable guide means for transporting the projectiles. Furthermore, it is preferred that the attachment comprises illumination means which can show operating states of the paintball backpack, for example by a blinking light. In the sense of the invention these operating states can be, for example, the filling level of the energy supply unit, which consists, for example, of a battery and/or of an accumulator. Another operating state can be, for example, the filling state of the storage container with projectiles. The average person skilled in the art knows which of the operating states and additional information can be displayed by illumination means.

In another aspect the invention relates to a method for delivering projectiles from a storage container of a paintball backpack according to the invention of the at least two delivery devices for transferring the projectiles to the device for firing the projectiles, comprising the following steps:

a) Making available a paintball backpack according to the invention in accordance with one or more of the previous claims, wherein a storage container of the paintball backpack is filled with a plurality of projectiles,
b) Operation of the delivery devices,
c) The delivery of the projectiles by the at least two delivery devices from the storage container for transferring the projectiles to the device for firing the projectiles, wherein the transfer of the projectiles takes place in the head area of the storage container.

The average person skilled in the art recognizes that technical features and advantages of preferred embodiments of the paintball backpack of the invention also apply to the method of the invention.

It was surprising that a method for delivering projectiles from a storage container to, for example, a marker can be made available with which a delivery of projectiles from a storage container to a device for firing the projectiles can be ensured which is more reliable and has a number of misfires which is significantly reduced in comparison the prior art. These advantages are advantageously achieved by making available a paintball backpack according to the invention with at least two delivery devices, wherein the transfer of the projectiles takes place in the head area of the storage container. Tests have shown that as a consequence of the transfer of the projectiles preferably taking place in the head area of the storage container, no difference in level to the device for firing the projectiles must be overcome since the head area of the storage container is advantageously provided at the same level as the device for firing the projectiles. The avoiding of overcoming a difference of level does not create any unfavorable pressure conditions in the delivery connection and in the movable guide means which could lead to the bursting or clamping of the projectiles. In particular, the avoidance of overcoming a difference of level also reduces the amount of energy which must be applied to deliver the projectiles. It was completely surprising that as a result of the preferred transfer of the projectiles in a head area of the storage container the means for making available the required energy, for example, batteries and/or accumulators, takes up less space than is customary in conventional devices from the prior art. If equally large batteries and/or accumulators are used, the supply time of the energy supply means was able to be surprisingly extended on account of the reduced consumption of energy.

It is preferred that in the method of the invention such a paintball backpack according to the invention is made available, wherein the storage container is filled with a plurality of projectiles. It is furthermore preferred, that the operation of the delivery devices preferably comprises die rotation of the rotors, which preferably form the delivery device. The operation of the delivery devices advantageously ensures a clocked delivery of the projectiles in that the projectiles fall out of a delivery area and/or take-in area of the first delivery device and/or of a storage plane of an at least second delivery device into the delivery pocket of the delivery device where they are guided by the rotation to a delivery connection and are guided by a delivery force through the delivery connection either to another delivery device or through a movable guide means to the device for firing the projectiles.

In another preferred embodiment of the invention a synchronization of the operation of the at least two delivery devices takes place by an axle for transmitting a delivery force. It is preferred that this axle is a rigid metallic rod which connects the at least two delivery devices to one another. The axle for the transmission of the delivery force is advantageously arranged on the center of the rotors preferably forming the delivery devices. This center of the rotors is preferably also designated in the sense of the invention as a hub. It was completely surprising that as a consequence of the rigid connection of the at least two delivery devices a synchronization of them can be achieved which results in the considerable improvement of the delivery quality of the paintball backpack according to the invention in comparison to traditional devices known from the prior art.

In another preferred embodiment of the invention the synchronization of the operation of the at least two delivery devices takes place by using at least two identical electromotors and/or by an electrical and/or controlling of at least two electromotors. It can be preferred for a few applications of the method according to the invention that the generation of a delivery force preferably takes place by two preferably identical electromotors, wherein a first electromotor preferably drives a first delivery device and a second electromotor drives the at least one second delivery device. By using preferably identical electromotors, the electromotors have the same parameters of movement and/or of rotation which preferably comprise the speed of the turning and/or rotation and therefore advantageously influence the delivery rate. It is preferable in the sense of the invention that the preferably identical electromotors are operated at the same speed. It was completely surprising that the using of two electromotors can achieve a synchronization of the two delivery devices in the sense of the same clocking of the two delivery devices.

Furthermore, it can be preferred for a few other applications that the synchronization of the operation of the at least two delivery devices takes place by an electronic and/or sensory controlling of at least two electromotors. In this case it is preferable that, for example, different electromotors are used to operate the at least two delivery devices, and that a synchronization takes place by a common electronic and/or sensory control and/or regulation. For example, it can be determined here when projectiles are transferred from a lower, first delivery device by the delivery connection to the upper, second delivery device. Based on the data detected, for example by the sensors, the operation of the, for example second delivery device can be optimally adapted to the operation of the first delivery device which is preferably driven by a first electromotor. The sensors are selected, for example, from a group comprising optical and/or acoustic sensors. It was completely surprising that by using an electronic control and/or regulation of the at least two electromotors an optimal synchronization of the at least two delivery devices and an associated optimization of the delivery of the projectiles can be achieved.

Figure 2:
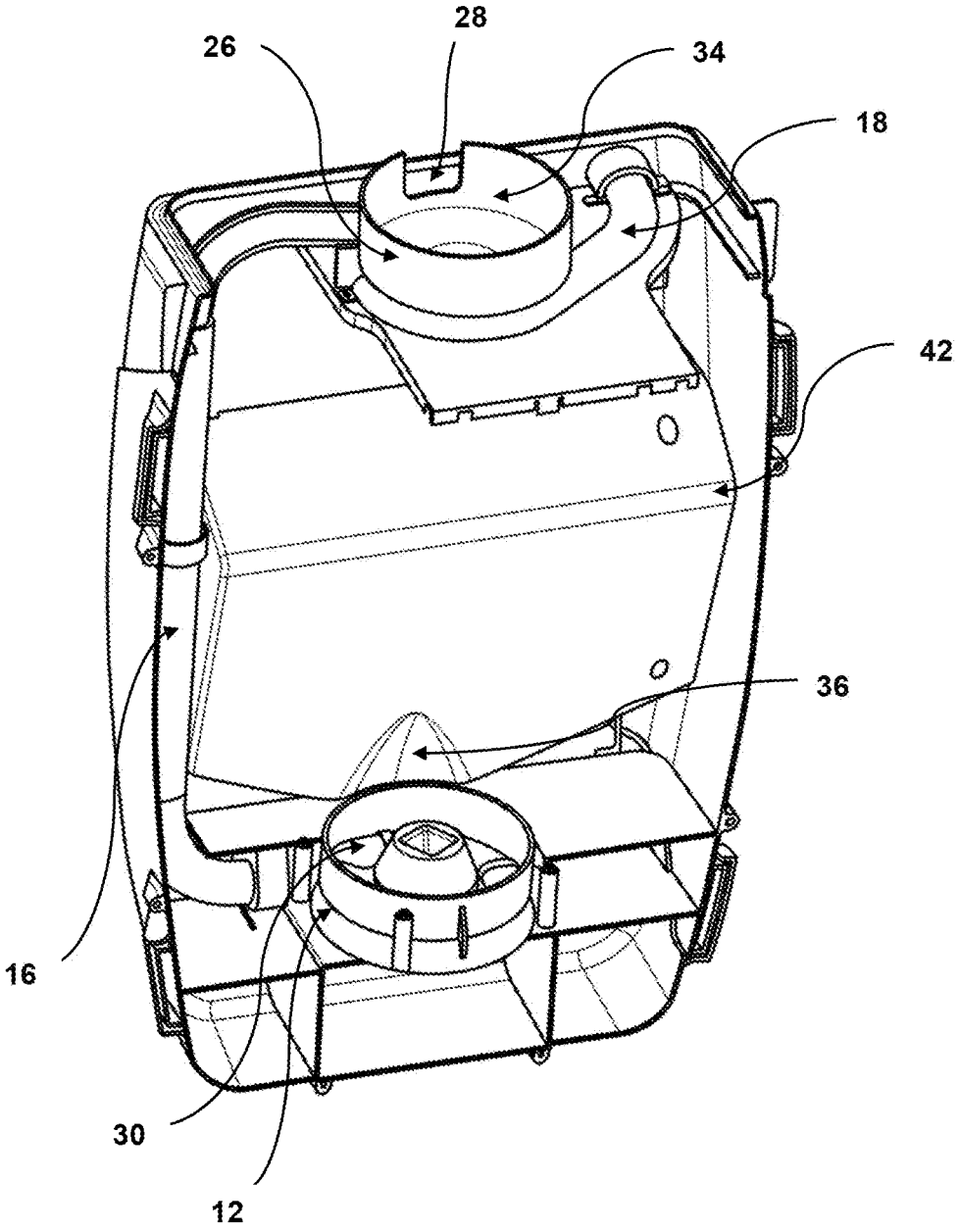
Figure 3:
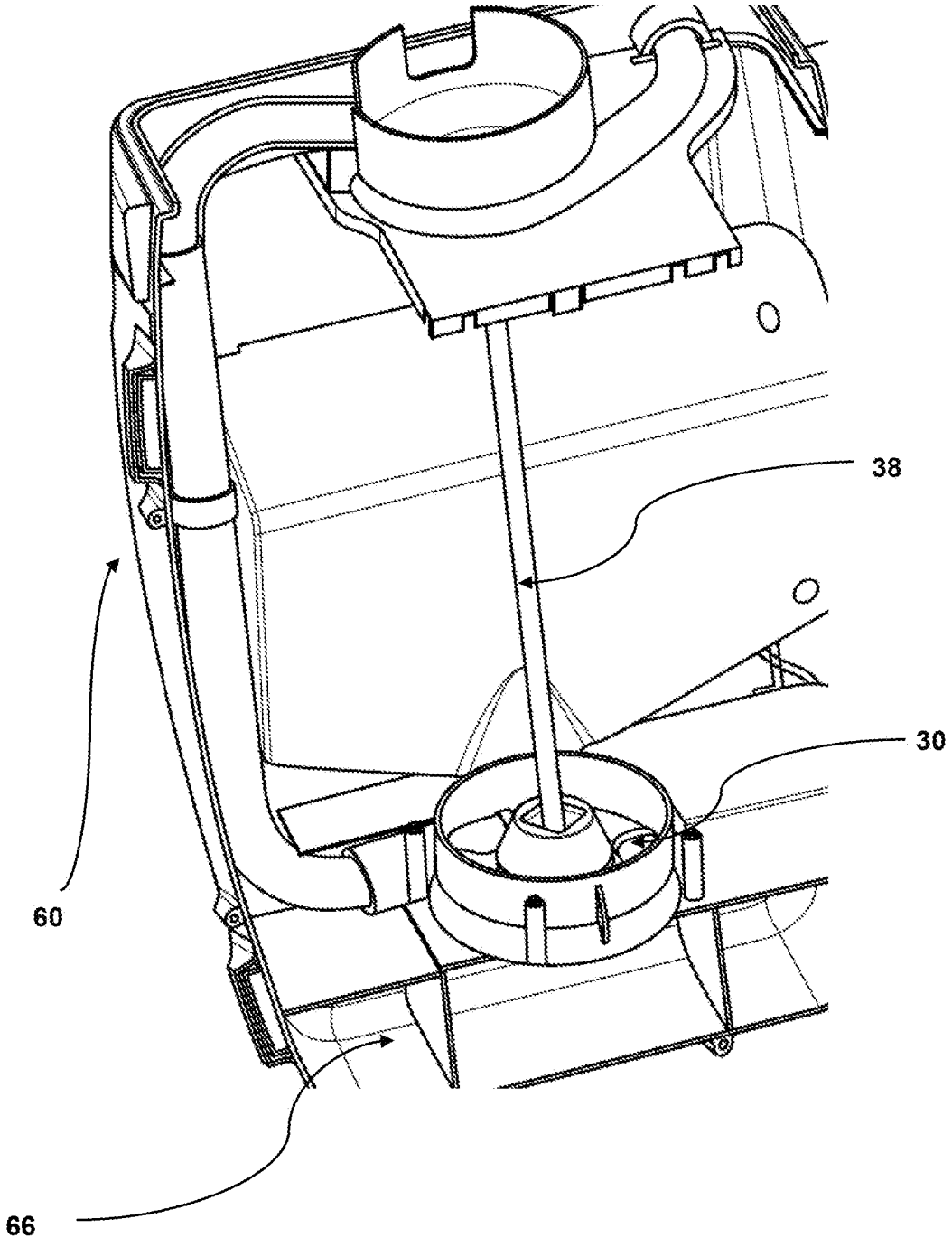
Figure 4:
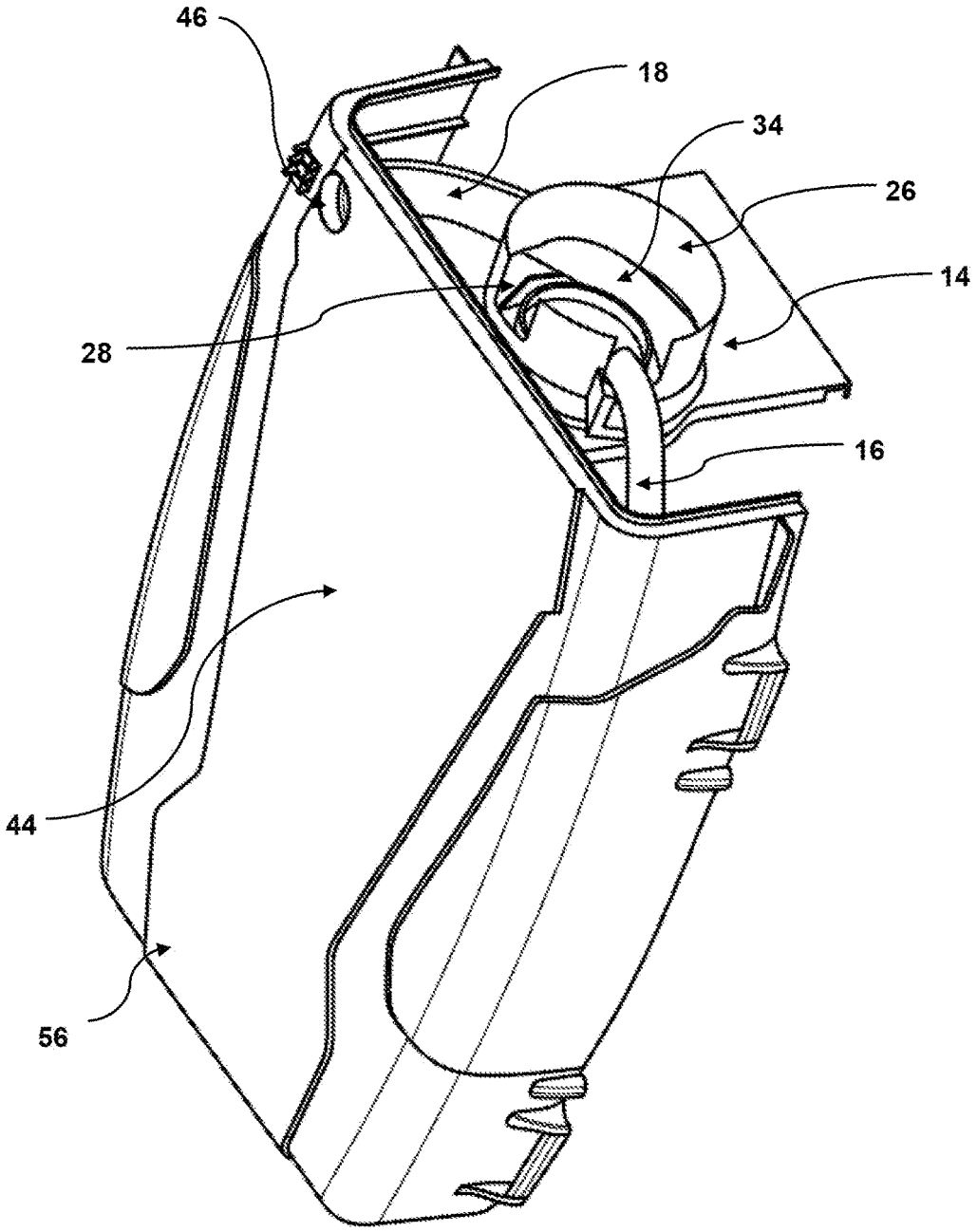
Figure 5:
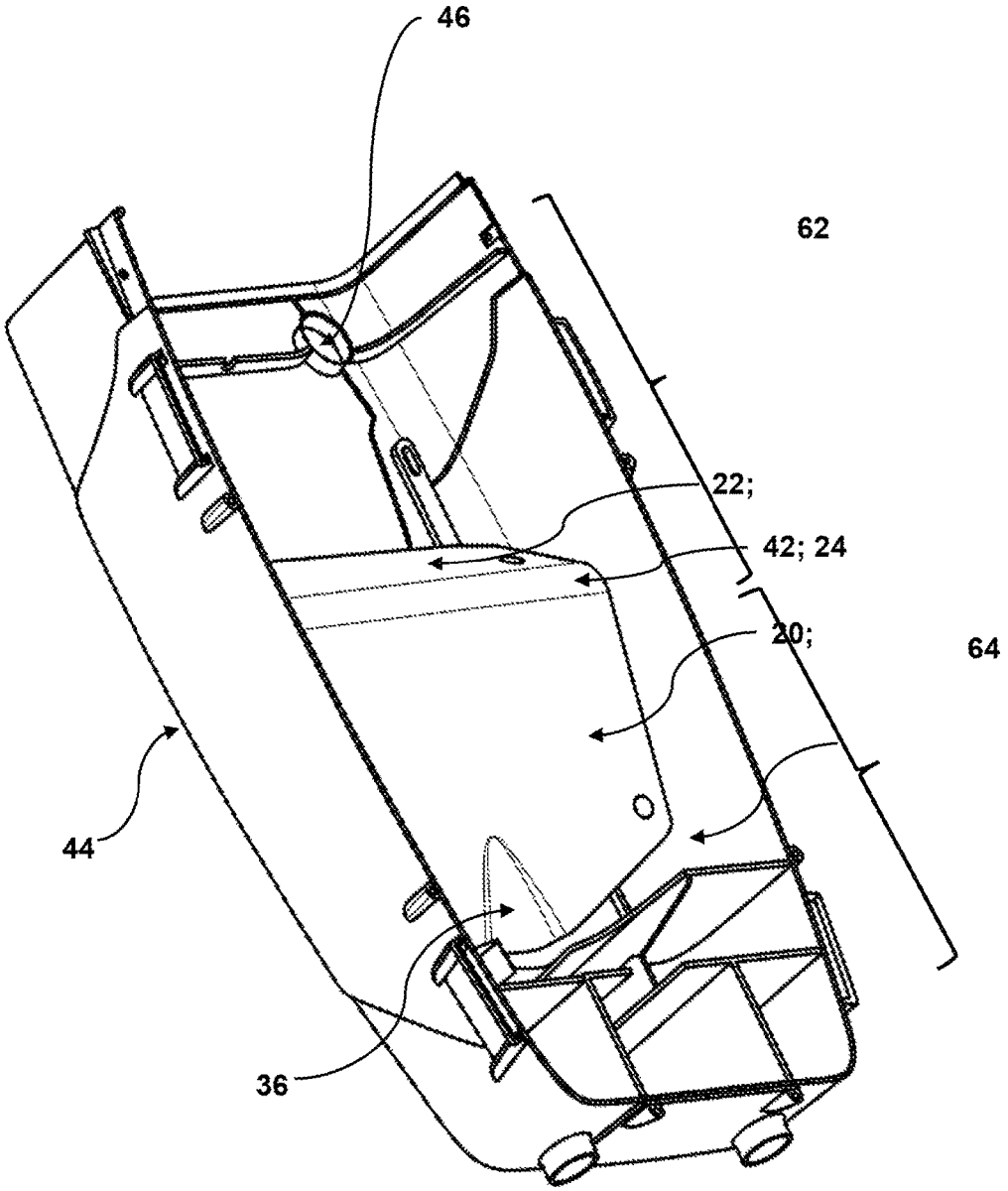

The invention is explained in detail in the following using exemplary embodiments and the following figures. In the figures:

FIG. 1: shows an exemplary embodiment of a paintball backpack according to the invention with a first and a second delivery device, FIG. 2: shows the interior of a storage container of a preferred embodiment of the paintball backpack according to the invention, FIG. 3: shows a preferred embodiment of the paintball backpack according to the invention, wherein a synchronization of the two delivery devices: is realized by an axle, FIG. 4: shows the head area of a preferred embodiment of the paintball backpack according to the invention, FIG. 5: shows the interior of a storage container of a preferred embodiment of the paintball backpack according to the invention, and FIG. 6: shows a preferred embodiment of the outer wall of the paintball backpack according to the invention.

FIG. 1 shows an exemplary embodiment of a paintball backpack (10) according to the invention with a first (12) and a second delivery device (14). The two delivery devices (12, 14) are connected to one another by a delivery connection (16). In the exemplary embodiment of the invention shown in FIG. 1 the delivery devices (12, 14) and the delivery connection (16) are in the inner chamber of a storage container (40). In addition, a guide structure (24) consisting of a first (20) and a second, oblique plane (22) is present in the inner chamber of the storage container. The arrangement of the two oblique planes (20, 22) forms a plateau area (42) from which projectiles present in the inner chamber of the storage container (40) move in the direction of a head area (52) and of a bottom area (54) of the storage container (40). The first (20) one of the two oblique (planes (20) 22) comprises a recess (36) in the lower area which imitates the circular shape of the first delivery device (12).

FIG. 1 furthermore shows another delivery connection (18) which runs from the second delivery device (14) to an opening (46). The paintball backpack (10) of the invention is suitable for the storage, transportation and delivery of projectiles. The projectiles are located in the storage container (40) of the paintball backpack (10), which is carried by a player when playing paintball. The paintball backpack (10) comprises carrier belts (not shown) on its back side (44) with which the backpack (10) can be carried in a known manner on the back of a player. The bottom area (54) of the paintball backpack (10) is usually located at the level of the hip of the user when the paintball backpack (10) is being carried, whereas the head area (52) of the paintball backpack (10) is located at the level of the player's throat and/or neck. As a result of the downwardly acting gravity (58), the projectiles are collected in the, for example, funnel-shaped bottom area (54) of the storage container (40). Therefore, the projectiles pass into the take-in an area of the first delivery device (12), wherein the first delivery device (12) can be, for example, a rotor, a delivery chain and/or a delivery worm. The first delivery device (12) comprises delivery pockets (30) which are present arranged on a partial circle of the first delivery device (12), wherein the first delivery device (12) has a circular base surface in the exemplary embodiment shown in FIG. 1. The projectiles pass by a rotary movement of the first delivery device (12) into a delivery connection (16) formed in the present exemplary embodiment by a stable plastic tube. The first (12) and the second delivery device (14) are driven by drive means, wherein the drive means can be, for example, electromotors. The projectiles are transported through the delivery connection (16) counter to the force of gravity (58) to a second delivery device (14). In the exemplary embodiment of the paintball backpack (10) according to the invention and shown in FIG. 1 the second delivery device (14) is arranged in the head area (52) of the backpack (10).

FIG. 2 shows the inner chamber of a storage container (40) of a preferred embodiment of the paintball backpack (10) according to the invention. In particular the second delivery device (14) can be seen which has a circular base surface area and a side wall (26) in the embodiment shown, wherein the side wall (26) imitates the circular base surface area of the second delivery device (14). The side wall (26) is located above the second delivery device (14) and forms in the shown embodiment of the invention a storage plane (34) into which the projectiles pass through the delivery connection (16) from the first delivery device (12). The projectiles are stored in the storage plane (34) before they also fall by gravity (58) into the delivery pockets (not shown) of the second delivery device (14). From the second delivery device (14) the projectiles are delivered through another delivery connection (18) to an opening (46) in the outer wall (56) of the paintball backpack (10) according to the invention. The other delivery connection (18) can be formed, for example, by a hose or a tube.

A surplus of projectiles develops in the storage plane (34) above the second delivery device (14) which makes it possible that a continuous supplying of the second delivery device (14) with projectiles is ensured. For the case that there is no additional space for additional projectiles in the storage plane (34), an overflow device (28) is provided in the side wall (26) of the second delivery device (14). The overflow device (28) is formed in the exemplary embodiment of the paintball backpack (10) according to the invention and shown in FIG. 2 by an opening in the side wall (26) through which the excess projectiles can be discharged from the storage plane (34). These projectiles which leave the storage plane (34) through the overflow device (28) pass back into the storage container (40) and back again into the take-in the area of the first delivery device (12) by the force gravity (58).

Furthermore, FIG. 2 shows the bottom area (54) of the storage container (40) of the paintball backpack (10) according to the invention. In the embodiment shown the bottom area (54) is formed by a funnel-shaped bottom surface (32) whose lowest point is formed by the first delivery device (12). As a result of the funnel-shaped design of the bottom surface (32), the projectiles located in the bottom area (54) of the storage container (40) pass into the take-in the area of the first delivery device (12). Furthermore, FIG. 2 shows the delivery pockets (30) of the rotor, which forms the first delivery device (12) in the embodiment of the invention shown.

FIG. 3 shows a preferred embodiment of the invention, wherein a synchronization of the two delivery devices shown (12, 14) is realized by an axle (38) connecting the two delivery devices (12, 14) to one another. It can be seen that the axle (38) connects to one another in particular the central areas of the delivery devices (12, 14), which are circular in this exemplary embodiment. These central areas of the delivery device (12, 14) are formed, for example, by hubs of the rotors which form the delivery devices (12, 14). Illustration 3 clearly shows the delivery pockets (30) of the first delivery device (12). Moreover, FIG. 3 shows that the delivery connection (16) is located in the area of a side wall (60) of the storage container (40).

FIG. 4 shows the head area (52) of a preferred embodiment of the invention. In particular the second delivery device (14) can be seen with a side wall (26) forming a storage plane (34). An opening (28) is present in this side wall (26) and is also designated as an overflow device. In the embodiment of the invention shown the opening (28) of the side wall (26) of the second delivery device (14) is located in the area of the back side (44) of the storage container (40). When the paintball backpack (10) is being carried by a user the back side (44) of the paintball backpack (10) rests on the user's back. Carrier belts (not shown) can be provided on this back side (44) of the paintball backpack (10) which make it possible to carry the paintball backpack (10) in a known manner. An opening (46) is present in the head area (52) in the outer wall (56) which forms the back side (44) of the paintball backpack (10) into which opening the other delivery connection (18) coming from the second delivery device (14) empties. Therefore, the transfer of the projectiles from the storage container to the device for shooting the projectiles such as, e.g., a marker takes place via the opening (46).

FIG. 5 shows the inner chamber of the storage container (40) of an embodiment of the invention and shows in particular the guide structure (24). The guide structure (24) is formed in the embodiment shown by two oblique planes (20, 22) that are not equally large and form a plateau area (42) of the guide structure (24) in a transitional area between these two oblique planes (20, 22). After this plateau area (42) the projectiles pass due to the force of gravity (58) either into an upper area (62) or into a lower area (64) of the storage container (40). The guide structure (24) shown in FIG. 5 ensures a frictionless operation of the paintball backpack (10) according to the invention in particular when the user of the paintball backpack (10) is lying, for example, on the ground in order to fire projectiles with the device for firing the projectiles. In this lying position of the user the outer wall (56) of the paintball backpack (10) is arranged substantially parallel to the ground on which the user is lying. Therefore, the force of gravity (58) acts in this lying position in the direction of the back side (44) of the paintball backpack (10). In order to ensure a continuous supplying of the second delivery device (14, not shown in FIG. 5), the guide structure (24) consisting of the two oblique planes (20, 22) is provided in the storage container (40) in order that the projectiles pass into the take-in area of the first delivery device (12). Without such a guide structure (24) the projectiles would be distributed in a lying position of the user uniformly on the back side (44) of the paintball backpack (10) according to the invention due to the unfavorable action of gravity, which would render a continuous supplying of the first delivery device with projectiles in this lying position significantly more difficult. The guide structure (24) overcomes this challenge in that the projectiles pass from a plateau area (42) of the guide structure (24) in particular into the lower area (64) of the storage container (40).

Figure 6A:
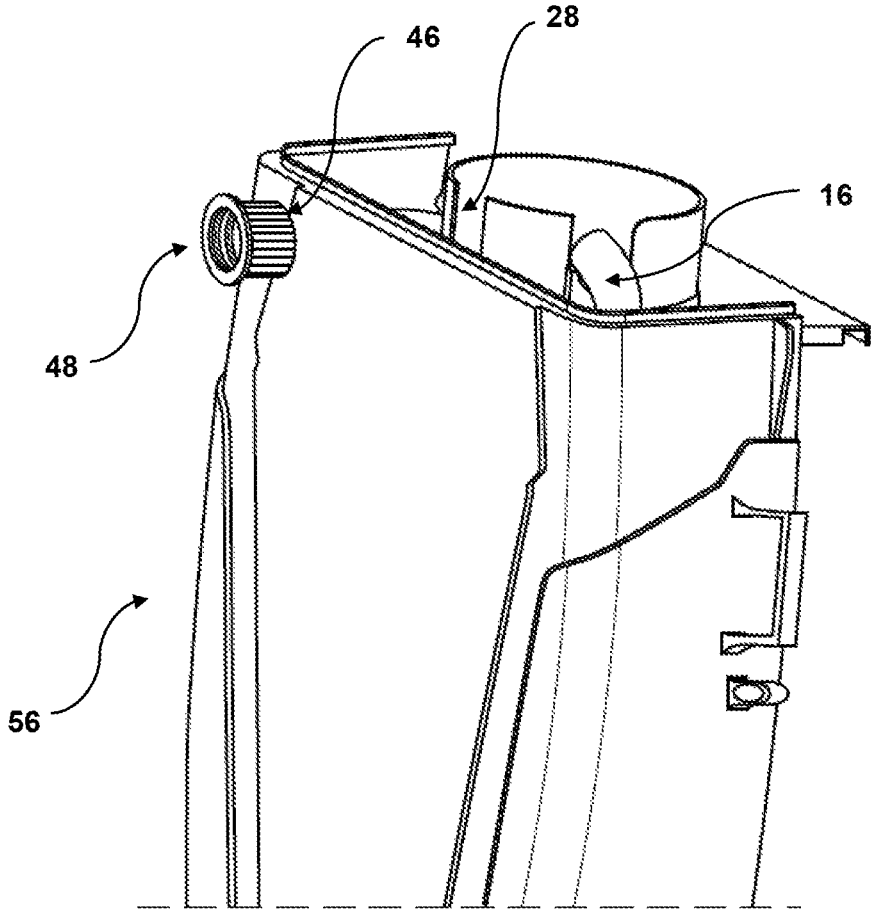
Figure 6B:
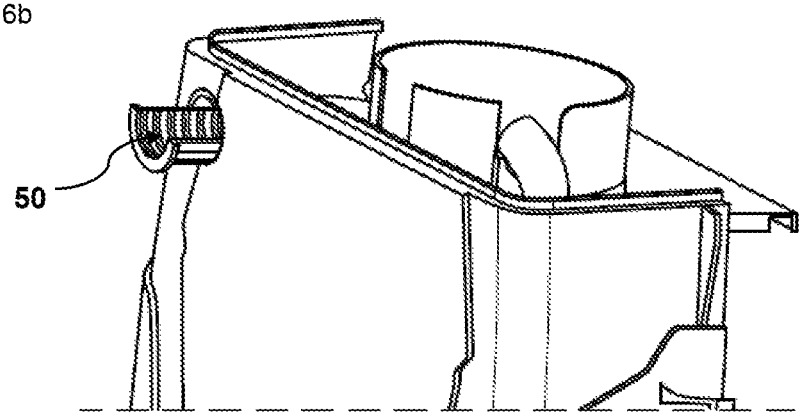

FIG. 6*a* shows a preferred embodiment of the outside wall of the paintball backpack (10) according to the invention. The opening (46) can be seen in the outside wall (56) of the paintball backpack (10), wherein the opening (46) is provided with an adapter (48) in the embodiment shown. The projectiles pass through this adapter (48) from the other delivery connection (18) into a movable guide means (not shown) which connects the paintball backpack (10) to a device for firing the projectiles. According to FIG. 6*b* the adapter (48) can be constructed in two parts, as a result of which when the two adapter halves are joined together a movable guide means can be clamped in or squeezed in between the two adapter components. An especially stable fastening of the connection means is ensured by the squeezing or clamping of the connection means by the two components of the adapter (48). In a preferred embodiment of the invention the components of the adapter (48) can comprise an inner threading (50) so that a connection means can also be screwed, for example, into the adapter (48).

LIST OF REFERENCE NUMERALS

10 paintball backpack
12 first delivery device
14 second delivery device
16 delivery connection
18 other delivery connection
20 first oblique plane
22 second oblique plane
24 guide structure
26 side wall of the second delivery device
28 overflow device
30 delivery pocket
32 funnel-shaped bottom area of the storage container
34 storage plane
36 recess in the first oblique plane
38 axle
40 storage container
42 plateau area of the guide structure
44 back side of the paintball backpack
46 opening for transferring the projectiles
48 bipartite transfer means
50 threading
52 head area of the storage container
54 bottom area of the storage container
56 outside wall of the paintball backpack
58 gravity
60 side wall of the paintball backpack
62 upper area of the storage container
64 lower area of the storage container
66 safety coupling

The invention claimed is:

1. A paintball backpack for storing, transporting and/or delivering projectiles to a device for firing the projectiles, comprising:

a storage container for the projectiles and at least one delivery connection for transporting the projectiles, wherein the paintball backpack comprises:

a first delivery device in a bottom area of the storage container and at least one second delivery device in a head area of the storage container, wherein the first delivery device and the at least one second delivery device are arranged superposed over each other in and/or on a storage container and are connected to each other by the at least one delivery connection; and, an opening in the head area for transferring the projectiles to the device for firing the projectiles.

2. The paintball backpack according to claim 1, wherein the at least one second delivery device comprises a storage plane, wherein the storage plane serves for an intermediate storage of the projectiles and the second delivery device is connected to the opening for transferring the projectiles by a delivery connection.

3. The paintball backpack according to claim 2, wherein the at least one storage plane is arranged in a head area of the storage container and is surrounded by a side wall and/or is formed by a funnel-shaped intermediate plane.

4. The paintball backpack according to claim 2, wherein the storage plane of the at least one second delivery device, which is arranged in a head area of the storage container and/or is formed by a funnel-shaped intermediate plane, comprises an overflow device.

5. The paintball backpack according to claim 1, wherein an axle for transferring a delivery force connects the first delivery device and at least one second delivery device to each other in such a manner that an operation of the at least two delivery devices can be synchronized.

6. The paintball backpack according to claim 1, wherein the at least two delivery devices comprise rotors, delivery worms, delivery chains and/or drive means for generating a delivery force, wherein the drive means for generating a delivery force are selected from a group comprising at least one electromotor, an internal combustion engine and/or a device for generating compressed air.

7. The paintball backpack according to claim 1, wherein the first delivery device comprises a motor and a mechanical safety coupling, as a result of which, when a maximum delivery force is exceeded, the delivery of the projectiles is decoupled from the motor movement.

8. The paintball backpack according to claim 1, wherein a guide structure consisting of two oblique planes is arranged in the inner chamber of the storage container, wherein the two oblique planes are connected to one another in such a manner that they form a rounded-off connection edge with one another in an upper area of the storage container which constitutes a plateau area of the guide structure, wherein the projectiles are guided from this plateau area by the two oblique planes in the direction of a head area of the storage container and/or in the direction of the first and/or of another delivery device.

9. The paintball backpack according to claim 1, wherein the paintball backpack comprises a carrier system to which belts for carrying the paintball backpack are attached.

10. The paintball backpack according to claim 1, wherein the at least one second delivery device, which is arranged in the head area of the storage container, can be attached to a device for firing the projectiles by another delivery connection, a connection means and/or a movable guide means for transporting the projectiles.

11. The paintball backpack according to claim 10, wherein a length of the movable guide means can be variably adapted to body prerequisites of the user of the paintball backpack.

12. The paintball backpack according to claim 1, wherein the device for firing the projectiles comprises illumination means for displaying operating states of the paintball backpack.

13. A method for delivering projectiles from a storage container of a paintball backpack according to claim 1 by the at least two delivery devices for transferring the projectiles to the device for firing the projectiles, comprising:

a) providing the paintball backpack, wherein the storage container of the paintball backpack is filled with a plurality of projectiles, b) operating the delivery devices, c) delivering the projectiles by the at least two delivery devices from the storage container for transferring the projectiles to the device for firing the projectiles, wherein the transfer of the projectiles takes place in the head area of the storage container.

14. The method according to claim 13, wherein a synchronization of an operation of the at least two delivery devices takes place by an axle for transferring a delivery force.

15. The method according to claim 13, wherein a synchronization of the operation of the at least two delivery devices takes place by using at least two identical electromotors and/or by an electronic and/or sensory controlling of at least two electromotors.

* * * * *